US010945547B2

(12) United States Patent
Denton

(10) Patent No.: US 10,945,547 B2
(45) Date of Patent: Mar. 16, 2021

(54) DRESSING AID

(71) Applicant: DEROSA DESIGNS LLC, Dallas, TX (US)

(72) Inventor: Kristin Derosa Denton, Dallas, TX (US)

(73) Assignee: DEROSA DESIGNS LLC, Dallas, TX (US)

( * ) Notice: Subject to any disclaimer, the term of this patent is extended or adjusted under 35 U.S.C. 154(b) by 0 days.

(21) Appl. No.: 16/672,084

(22) Filed: Nov. 1, 2019

(65) Prior Publication Data

US 2020/0138220 A1 May 7, 2020

Related U.S. Application Data

(60) Provisional application No. 62/755,046, filed on Nov. 2, 2018.

(51) Int. Cl.

| | |
|---|---|
| ***A47G 25/90*** | (2006.01) |
| ***A44B 19/28*** | (2006.01) |
| ***A44B 19/26*** | (2006.01) |

(52) U.S. Cl.

CPC ..... *A47G 25/902* (2013.01); *A44B 19/262* (2013.01); *A44B 19/285* (2013.01)

(58) Field of Classification Search

CPC .... A47G 25/902; A44B 19/262; A44B 19/285
USPC ..... 294/3.6
See application file for complete search history.

(56) References Cited

U.S. PATENT DOCUMENTS

| | | | | |
|---|---|---|---|---|
| 2,888,728 | A * | 6/1959 | Lebermann | A47G 25/902 294/3.6 |
| 5,855,401 | A * | 1/1999 | Papernik | A47G 25/901 24/40 |
| 5,921,591 | A * | 7/1999 | Argent | E21B 17/0426 228/135 |
| 6,032,996 | A * | 3/2000 | Kogen | A47G 25/901 294/2 |
| 6,112,958 | A * | 9/2000 | LaMacchia | A47G 25/901 223/111 |
| 6,243,921 | B1 * | 6/2001 | Chang | A61J 17/00 24/3.13 |
| 7,121,222 | B1 * | 10/2006 | Johnston | B63B 21/22 114/293 |
| 7,575,224 | B1 * | 8/2009 | Madland | B66D 3/04 24/71 ST |
| 8,281,966 | B2 * | 10/2012 | Rodgers | A47G 25/901 223/111 |
| 8,910,983 | B1 * | 12/2014 | Neff | A47G 25/902 24/429 |
| 8,978,594 | B2 * | 3/2015 | Daniels | A01K 27/004 119/795 |
| 9,289,084 | B1 * | 3/2016 | McKeown | A44B 19/262 |
| 9,623,806 | B2 * | 4/2017 | Rodriguez | B60R 7/043 |
| 2005/0072819 | A1 * | 4/2005 | Maldonado | A45F 5/021 224/162 |

(Continued)

*Primary Examiner* — Stephen A Vu

(57) ABSTRACT

Various embodiments of a dressing aid are disclosed. In one embodiment, a dressing aid, comprises a grip; an extender extending from the grip, the extender having a proximal end and a distal end; a clasping mechanism coupled with the distal end of the extender; and a locking mechanism configured to lock the extender into a fixed position such that the clasping mechanism remains at a fixed length from the grip.

14 Claims, 4 Drawing Sheets

(56) References Cited

U.S. PATENT DOCUMENTS

2012/0169076 A1* 7/2012 Brake ..... A47G 25/902
294/3.6

* cited by examiner

DRESSING AID

CROSS-REFERENCE TO RELATED APPLICATION

This application claims the benefit of U.S. Provisional Application Ser. No. 62/755,046, filed by Kristin Derosa Denton on Nov. 2, 2018, entitled "DRESSING AID," commonly assigned with this application and incorporated herein by reference in its entirety.

TECHNICAL FIELD

This application is directed, in general, to dressing assistance devices and, more specifically, to a dressing aid to help people with zippers and hard to reach fasteners without the assistance of another person.

BRIEF DESCRIPTION

Reference is now made to the following descriptions taken in conjunction with the accompanying drawings, in which.

DETAILED DESCRIPTION

Many garments, shoes, and other accessories are equipped with zippers and other fasteners. Dresses, for example, often have zippers that begin below the hip area of a person and continue up to the neckline, and pants and dresses often have side zippers that are difficult to reach and manipulate. Certain areas of the back and side may be difficult for a person to reach and pull/manipulate the zipper, and the person may need to ask another person for assistance with the zipper or other fastener. As a result, someone that lives alone or is dressing at home or elsewhere alone, is travelling, in a dressing room, or other various situations when another person is not available to help, may not be able to fully dress. Likewise, persons with limited mobility may also have trouble reaching and manipulating zippers and fasteners in various areas of their body. For example, someone who has a limited range of motion and has trouble bending, for example, may not be able to fasten certain shoe fasteners or zippers, and in some cases, may also need assistance with socks and/or hosiery, or someone with limited range of motion of their arms may not be able to reach zippers in various locations. What is needed is an aid that enables a person to fasten a zipper or other fastener by themselves without the assistance of another person.

Figure 1A:
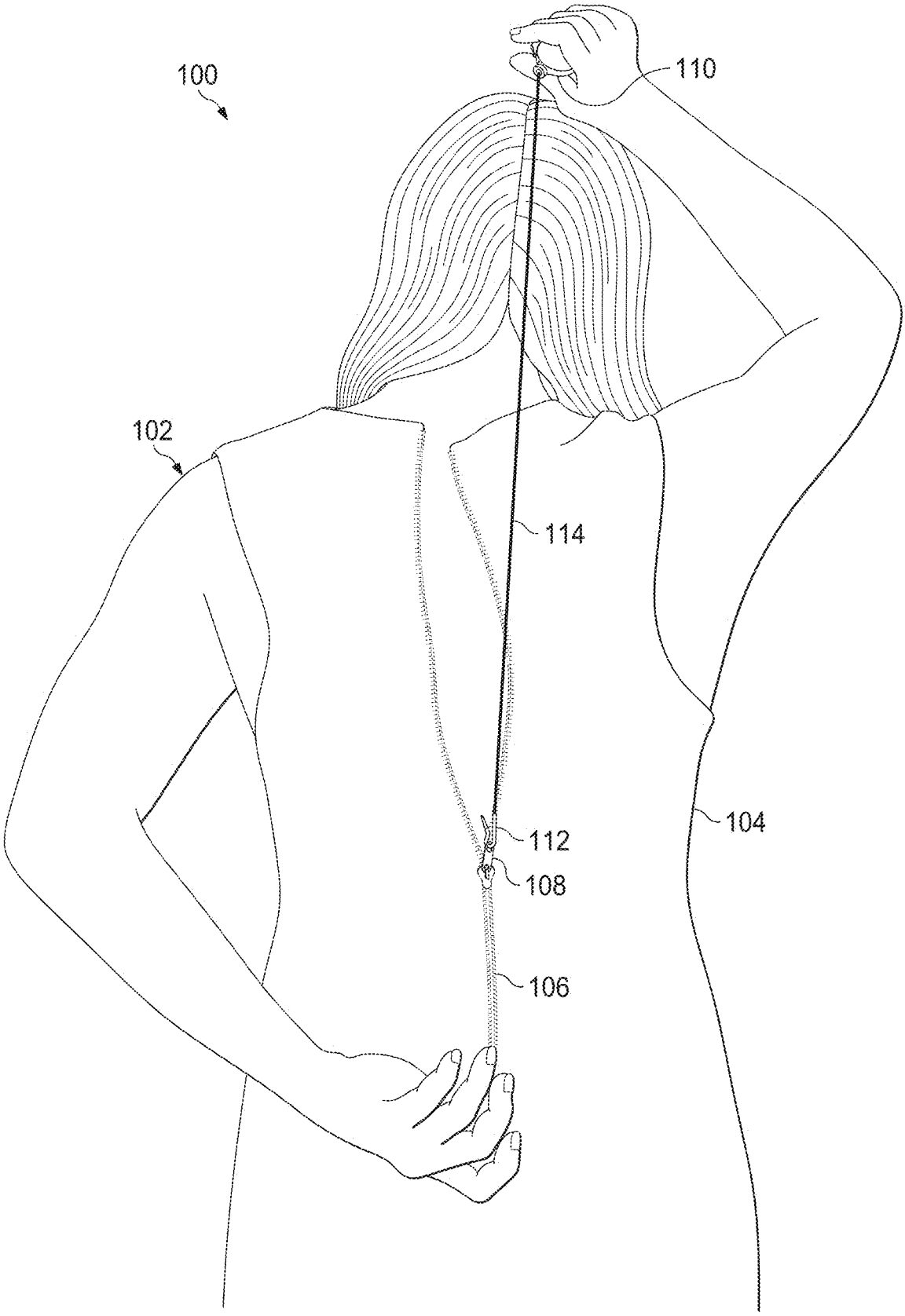
FIG. 1A illustrates an environmental view of one embodiment of a dressing aid according to the principles of the disclosure.
Figure 1B:
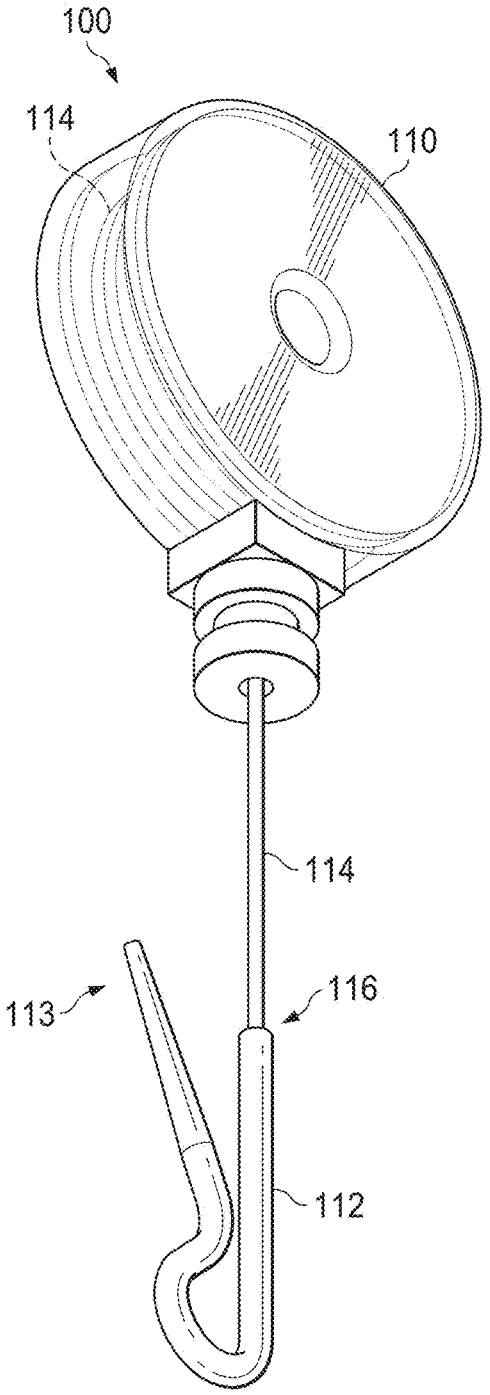
FIG. 1B is a perspective view of one side of the dressing aid shown in FIG. 1A.
Figure 1C:
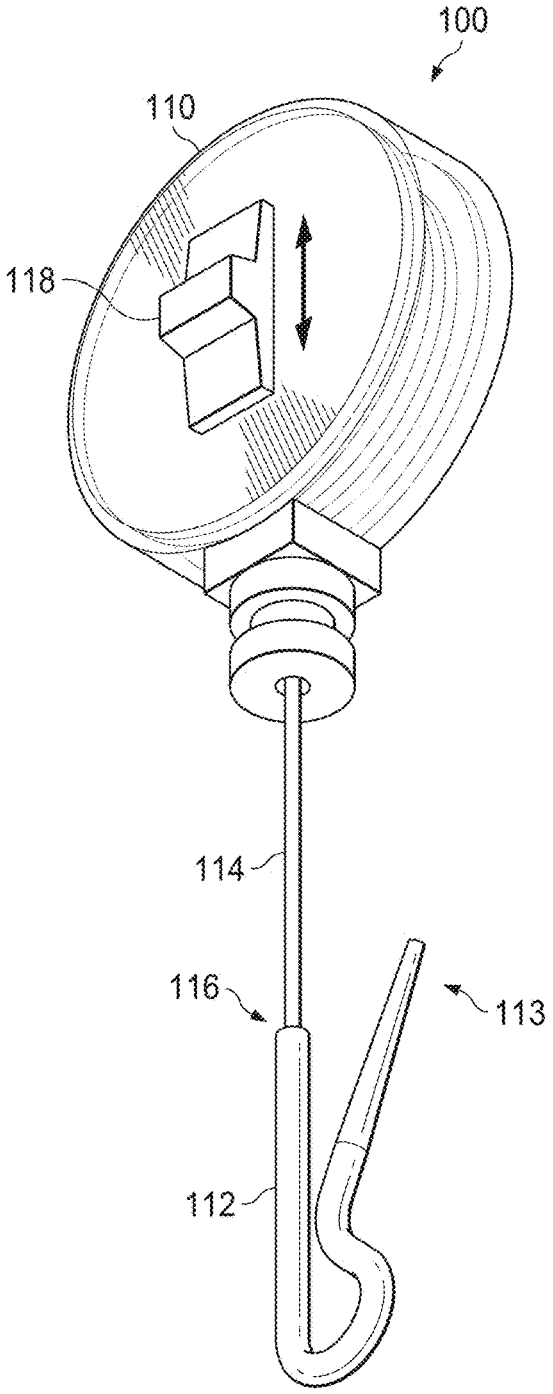
FIG. 1C is an alternative perspective view of another side of the dressing aid shown in FIG. 1A.

Referring now to FIG. 1A-1C, there is shown one embodiment of a dressing aid 100. Dressing Aid 100 has a grip 110 and a clasping mechanism, such as hook 112, configured to attach/couple or hook into a fastener. An extender 114 has a proximal end coupled with or within the grip 110 and a distal end 116. The extender 114 extends from the grip 110 and the hook 112 is coupled at or near the distal end 116 of the extender 114. The extender 114 may extend from and retract from within the grip 110 and may be locked at one or more desired lengths or positions by a locking mechanism 118.

Person 102 is shown in FIG. 1A is putting on a garment, such as dress 104 that has a long zipper 106 up the back of the dress 104. Once the garment is on, or perhaps in some cases, before the garment is put on, person 102 attaches the hook 112 into the zipper pull 108. Person 102 then moves the grip 110 into an initial manipulation position where person is able to manipulate the grip according to their range of motion. This may be at or near the top of person's 102 neck for a back zipper, but the initial manipulation position of grip 110 may be any position where person 102 is capable of manipulating the dressing aid 100 according to their range of motion and also according to the garment or accessory. As the grip 102 is being moved into the initial manipulation position, the extender 114 extends such that the hook 112 remains in the zipper pull 108. When the grip 110 reaches the initial manipulation position, person 102 engages locking mechanism 118 to maintain the hook 112 at a fixed length away from grip 110. Person 102 may then pull grip 110 upward and/or outward from the body to pull the zipper 106 up to its top, or closed position.

The hook 112 may be an s-type hook as shown, but the hook 112 may be in various shapes such that a distal end 113 of the hook 112 may be inserted and received into an opening in a fastener, such as, e.g. a zipper pull 108. The hook 112 may comprise metals, plastics, polymers, and various other materials or combination of materials used for hooks and clips known in the art.

The extender 114 may comprise metals, rope, synthetic materials, cords, plastics, textiles and any other material which may be retractable and capable of withstanding a resistance to move a zipper or other fastener. The extender 114 may be coupled within hook 112 or fastened at one end of the hook 112. In some embodiments, the extender 114 may be retractable around a center of rotation within the grip 110, similar to any retractable cord, such as a retractable badge cord, retractable vacuum cord, and any other retractable type cord or extender known in the art than enables an extension, such as extender 114 to move freely and be engaged or locked in one or more adjustable fixed positions. In some embodiments, the extender 114 may be a telescoping extender, such as a telescoping pole, and various other similar telescoping/extending lengths which may be locked in one or more fixed positions.

As shown in FIG. 1C, the locking mechanism 118 is sliding lock mechanism which may move between a locked and an unlocked position. In this embodiment, the locking mechanism 118 has a sliding bar positioned on a back side of grip 110 which moves in a horizontal motion. An interior portion of locking mechanism 118 is positioned within grip 110 and is configured to engage and disengage with extender 114. When the sliding bar is in a first, unlocked position, the interior portion of locking mechanism 118 is not engaged with the extender, enabling the extender to move freely within grip such that hook 112 may be positioned at any length from the grip 110, limited only by the length of the extender. In a second, locked position, the interior portion of locking mechanism engages the extender 114 and maintains the extender 114 at a fixed position such that hook 112 is fixed at a certain length from grip 110. When person 102 is ready to begin closing the zipper, the grip 110 is placed at the initial manipulation position and the locking mechanism is in the first, unlocked position. The locking mechanism 118 is moved into the second, locked position to fix the hook 112 at a fixed length from the grip 110. The locking mechanism 118 shown in FIG. 1A may function similarly to a sliding lock mechanism on, e.g., a tape measure having a retractable measuring tape, wherein locking mechanism has one or more components extending into the grip 110 in order to engage at least portion of extender 114 coiled or wrapped within the grip 110.

The grip 110 may comprise metals, plastics, polymers, rubbers, and various other materials used for handles, and capable of accommodating extender 114 coiled within and being locked into one or more lengths by locking mechanism. In the embodiment of dressing aid 100 shown in FIG. 1, grip 110 comprises a substantially clear, non-opaque plastic or polymer such the portion of extender 114 coiled within the grip is visible. Other embodiments, may comprise opaque materials such the interior of the grip 110 is not visible.

In the embodiment shown in FIG. 1A-1C, grip 110 has a substantially circular shape, but grip 110 may have a wide variety of shapes and forms which are easily grasped by a human hand. While FIGS. 2 and 3 show alternate embodiments of grip 110, the possible shapes for grip are numerous and not limited to the shapes or styles shown herein.

Figure 2:
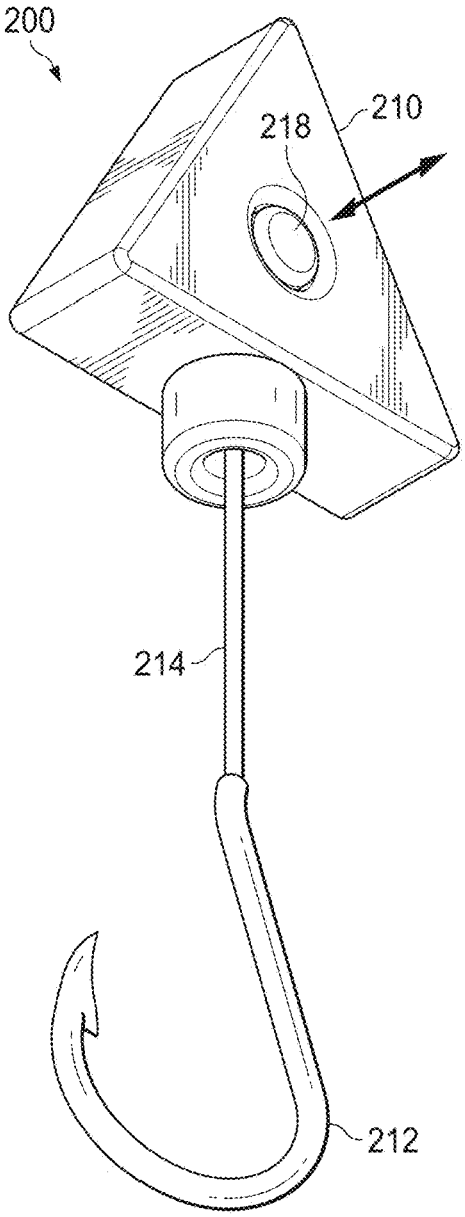
FIG. 2 is a perspective view of another embodiment of a dressing aid according to the principles of the disclosure.
Figure 3:
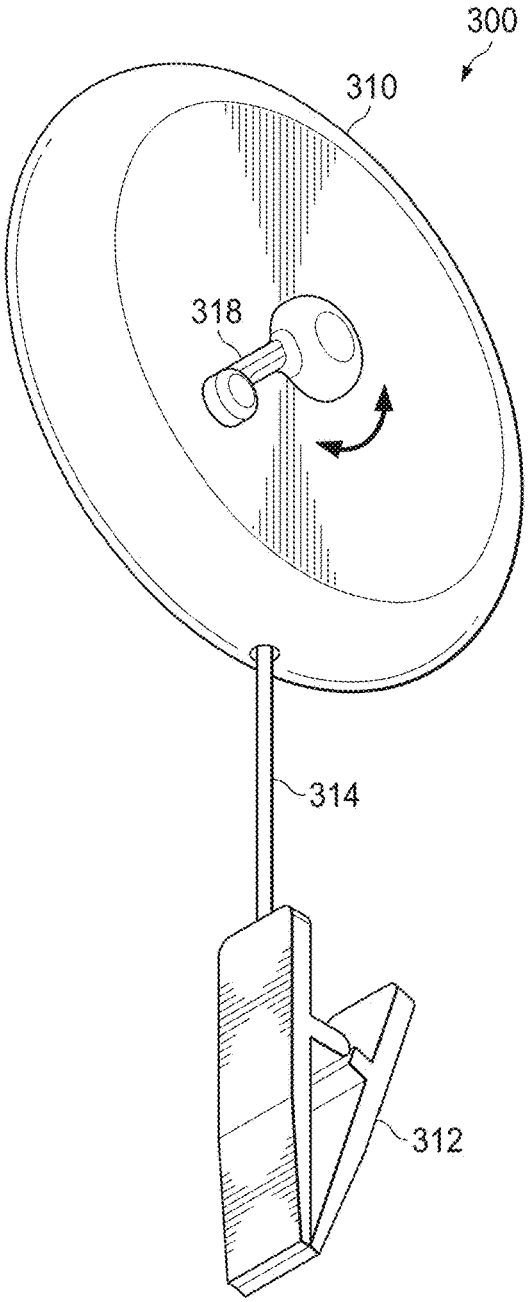
FIG. 3 is a perspective view of yet another embodiment of a dressing aid according to the principles of the disclosure.
Figure 4:
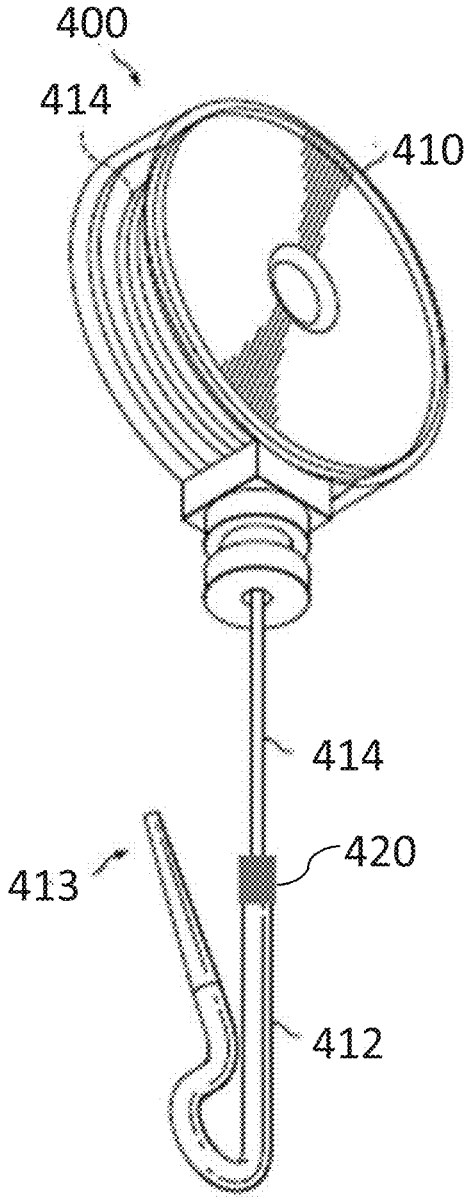
FIG. 4 is a perspective view of still another embodiment of a dressing aid according to the principles of the disclosure.

FIGS. 2, 3, and 4 illustrate alternate embodiments of dressing aid 100 which may have different features of dressing aid. FIG. 2 illustrates an embodiment of dressing aid 200 which may have some features similar to dressing aid 100. Dressing aid 200 includes at least a grip 210, an extender 214 extending from the grip, and a hook 212 at the distal end of the extender 214. In this embodiment, the grip 110 has a triangular shape. The locking mechanism 218 is a button having at least an un-pressed position, wherein the extender 214 moves freely in and out of the grip 210, and a second pressed position, wherein the extender 214 is locked at a fixed length. In this embodiment, hook 214 is similar to a fishing-style hook. The locking mechanism 218 shown in FIG. 2 may function similarly to a locking button on a tape measure similar to those used in the garment and tailoring industry.

In FIG. 3, dressing aid 300 includes a grip 310 which may be a rounded disc. Locking mechanism 318 is a handle having a first, unlocked position wherein extender 314 may move freely in and out of grip to various lengths, and a second, locked position, wherein the extender 314 is at a fixed length away from grip 310. In this embodiment, clasping mechanism 312 is a clip that may clip onto a fastener or an article of clothing or the like, rather than hooking through an opening in the fastener.

FIG. 4 illustrates an embodiment of dressing aid 400 which may have some features similar to dressing aid 100. Dressing aid 400 includes at least a grip 410, an extender 414 extending from the grip for coupling a removable clasping mechanism 412 with the extender 414. In some embodiments, the clasping mechanism 412 may be removable and replaceable from the extender 414 such that varying styles and sizes of a clasping mechanism 412 may be interchangeable and used with the same grip 410. For example, a person with limited mobility may use the dressing aid 400 to fasten several types of clothing, shoes, etc. including zippers, belts, shoes, socks, and various other apparel for which the person may need assistance when getting dressed. In this embodiment, the clasping mechanism 412 includes a hook 413, but other clasping mechanisms such as the hook 212 or clip 312 may be used and other suitable clasping mechanism which may be used to assist with fasteners or facilitating various tasks involved in getting dressed. The connector 420 may be configured such that clasping mechanism 412 may couple with the extender 414 in various ways. The connector 420 may be a tension fit connector, clip, snap fit connector, threaded connection, strap, locking pin, and other connecting means which provide for removable and interchangeable connections.

Various embodiments of a dressing aid have been shown and described herein. The embodiments of a dressing aid have been illustrated in conjunction with a back fastening garment, such as a dress, but the dressing aid may be used with fasteners of all types and locations. For example, a person with limited mobility may need to fasten or zip boots, shoes, pants, dresses, etc. with zippers or fasteners in various locations. The dressing aid may also be used by persons having limited strength or various other physical limitations and are unable to manipulate or operate a fastener. Those skilled in the art to which this application relates will appreciate that other and further additions, deletions, substitutions and modifications may be made to the described embodiments.

Aspects of a dressing aid are disclosed herein. In one Aspect A, a dressing aid includes a grip, an extender extending from the grip, and a hook coupled at a distal end of the grip. A locking mechanism is fastened onto the grip, the locking mechanism configured to engage the extender and lock the extender into a fixed position such that the hook remains at a fixed length from the grip. In another Aspect B, a dressing aid system includes a grip; an extender extending from the grip, the extender having a proximal end and a distal end; a plurality of clasping mechanisms; a connector for coupling one of the plurality of clasping mechanisms onto the distal end of the extender; and a locking mechanism configured to lock the extender into a fixed position such that the clasping mechanism remains at a fixed length from the grip.

Aspects A and B may have one or more of the following additional elements in combination: wherein the extender is positioned within the grip; wherein the extender is retractable; wherein the extender is coiled within the grip; wherein the extender comprises polymers; wherein the extender comprises a metal; wherein the locking mechanism is a switch on one side of the grip; wherein the locking mechanism is a button on one side of the grip; wherein the clasping mechanism is an s-shape hook; wherein the clasping mechanism is a fishing-style hook; wherein the clasping mechanism is a clip; wherein the grip has a circular shape; wherein the grip comprises a substantially clear plastic; wherein the locking mechanism is a switch on one side of the grip; wherein the hook is an s-shape hook; wherein the hook is a fishing-style hook; wherein the hook is a clip; wherein the extender comprises metals; wherein the extender comprises polymers; wherein the plurality of clasping mechanism includes at least one hook and one clip; and wherein the connector is one of a tension fit connector, clip, snap fit connector, threaded connection, strap, locking pin.

Those skilled in the art to which this application relates will appreciate that other and further additions, deletions, substitutions and modifications may be made to the described embodiments.

What is claimed is:

1. A dressing aid system, configured to assist in putting on an apparel, the system comprising:

a grip;

an extender extending from the grip, the extender having a proximal end and a distal end, wherein the proximal end of the extender is located within the grip and wherein the extender is retractable;

a plurality of interchangeable clasping mechanisms;

a connector for coupling one of the plurality of interchangeable removable clasping mechanisms onto the distal end of the extender; and a locking mechanism configured to lock the extender into a fixed position such that the clasping mechanism remains at a fixed length from the grip;

wherein the plurality of interchangeable clasping mechanisms is a kit including at least one hook and at least one clip, and configured to engage with a portion of the apparel.

2. The dressing aid system according to claim 1, wherein the connector is a threaded connection.

3. The dressing aid system according to claim 1, wherein the connector is a tension fit connector.

4. The dressing aid system according to claim 1, wherein the connector includes a clip.

5. The dressing aid system according to claim 1, wherein the at least one hook is a fishing style hook.

6. The dressing aid system according to claim 1, wherein the extender is coiled within the grip.

7. The dressing aid system according to claim 1, wherein the locking mechanism is a switch on one side of the grip.

8. The dressing aid system according to claim 1, wherein the locking mechanism is a button on one side of the grip.

9. The dressing aid system according to claim 1, wherein the extender comprises polymers.

10. The dressing aid system according to claim 1, wherein the extender comprises a metal.

11. The dressing aid system according to claim 1, wherein the grip has a circular shape.

12. The dressing aid system according to claim 1, wherein the grip has a triangular shape.

13. The dressing aid system according to claim 1, wherein the grip comprises a substantially clear plastic.

14. The dressing aid system according to claim 1, wherein the at least one hook is an S-shape hook.

* * * * *